US005856725A

United States Patent [19]

Ueda

[11] Patent Number: 5,856,725

[45] Date of Patent: Jan. 5, 1999

[54] SHADOW MASK WITH EDGE SLOTS CONFIGURATION

[75] Inventor: Masahiro Ueda, Shiga, Japan

[73] Assignee: NEC Corporation, Tokyo, Japan

[21] Appl. No.: 824,609

[22] Filed: Mar. 27, 1997

[30] Foreign Application Priority Data

Mar. 29, 1996 [JP] Japan ..... 8-075525

[51] Int. Cl.[6] ..... H01J 29/80

[52] U.S. Cl. ..... 313/402; 313/403; 313/407; 313/408

[58] Field of Search ..... 313/402, 403, 313/407, 408

[56] References Cited

U.S. PATENT DOCUMENTS 5,635,320 6/1997 Ohtake et al. ..... 313/403

*Primary Examiner*—Vip Patel

*Attorney, Agent, or Firm*—Sughrue, Mion, Zinn, Macpeak & Seas, PLLC

[57] ABSTRACT

In a shadow mask of the present invention applicable to a color CRT (Cathode Ray Tube), a part of slots located at the opposite edges of the mask each has a horizontal section so configured as to intercept or reduce the quantity of direct light contained in exposing light, while allowing reflections from, e.g., the casing of an exposing device to pass therethrough.

7 Claims, 6 Drawing Sheets

SHADOW MASK WITH EDGE SLOTS CONFIGURATION

BACKGROUND OF THE INVENTION

The present invention relates to a color CRT (Cathode Ray Tube) and, more particularly, to a shadow mask for a color CRT to produce a display which is free from the local omission of stripes ascribable to the short exposure of the mask's outermost slots, and a method for producing the same.

A shadow mask for a color CRT has a number of rectangular slots formed therein for allowing electron beams to pass therethrough. Each slot consists of a rectangular large hole and a rectangular small hole communicated to each other and respectively formed on the front and rear of the mask. Generally, at the center of the mask, the center of each large hole and that of the small hole associated therewith are coincident with each other. On the other hand, towards the edge of the mask, the centers of the small holes are each deviated from the centers of the associated large holes, the centers of the small holes being positioned closer towards the center of the mask than the centers of the large holes. The deviation of the centers of the large and small holes sequentially increases from the centers towards the edge of the mask. With this configuration, the mask minimizes the quantity of, among exposing light having an angle of incidence, light directly incident to the outermost slots and undesirably reflected by the walls of such slots.

To better understand the present invention, brief reference will be made to the basic structure of a conventional color CRT, shown in FIG. 1. As shown, the color CRT, generally 10, is implemented as a bulb 12 having a face panel 14 at its front end. A fluorescent surface 16 and a shadow mask 18 are sequentially stacked on the inner surface of the face panel 14 in this order. Electron guns (only one is visible) 20 are disposed in the neck portion of the bulb 12. An electron beam 22 issuing from any one of the electron guns 20 is deflected by an electric field formed by a deflection yoke 24. The deflected beam 22 scans the fluorescent surface 16 via the shadow mask 18 and thereby displays a picture on the surface 16.

To enhance the basic performance of the CRT or display 10, i.e., contrast and luminance, a black matrix film (BM film hereinafter) , not shown, is formed on the inner surface of the face panel 14 integrally with the fluorescent surface 16. The BM film consists of red, green and blue light emitting pixels, and graphite or similar light-absorbing substance filling the spaces between the light emitting pixels. A metal back film, not shown, reflects incident light while being isolated from the fluorescent surface 16. The metal back film is implemented by an aluminum film.

As shown in FIG. 2, the shadow mask 18 is formed with a number of rectangular slots 26 for passing electron beams therethrough. The slots 26 each has a length L in the vertical direction V and a width S in the horizontal direction H. The slots 26 adjoining in the vertical direction V are spaced by bridge portions 28 while the slots 26 adjoining in the horizontal direction H are spaced by connecting portions 30. To form the slots 26, a particular rectangular resist pattern is formed on each of the front (facing the fluorescent surface 16) and the rear (facing the electron guns 20) of the material of the shadow mask 18, and then the material is etched. The resist patterns are rectangular, and each is long in the vertical direction V of the screen and short in the horizontal direction H of the same.

Specifically, as shown in FIG. 3, rectangular large holes 26L and rectangular small holes 26S are respectively formed in the front and rear of the shadow mask 18 by etching, constituting the desired slots 26. At the center of the shadow mask 18, the center CL of the large hole 26L and the center CS of the small hole 26S forming one slot 26 together with the hole 26L are coincident with each other. On the other hand, in slots towards the edge of the shadow mask, the centers CS of the other small holes 26S are deviated from the centers CL of the associated large holes 26L, with the center of the small holes skewed towards the center of the mask. The deviation of the center CS from the center CL is designed to sequentially increase from the center towards the outer horizontal edges of the shadow mask 18. Stated another way, the sectional configurations of the slots 26 are sequentially varied in order to increase the width S, FIG. 2, little by little toward the edges of the shadow mask 18. With this configuration, the mask 18 minimizes the quantity of, among exposing light having an angle of incidence, light directly incident to the slots 26 and undesirably reflected by the walls of the slots 26.

As stated above, during exposure for forming the fluorescent surface 16 on the inner surface of the face panel 14, the shadow mask 18 and face panel 14 are exposed in a pair so as to form the BM film. The exposure is influenced by the angle of the exposing light incident to the slots 26 and the width S of the slots 26. In light of this, basically all the slots 26 have their sections, as seen in the direction III—III of FIG. 2, sequentially varied in order to increase the width S little by little, as stated above.

However, the shadow mask 18 described above has the following problem left unsolved. As shown in FIG. 2, the mask 18 has a slot area 32 where the slots 26 are present and a non-slot area 34 where the slots 26 are absent. Consider the slots 26 located at the opposite edges of the area 32, particularly a slot 26*a* close to the corner of the mask 18. Because the slot 26*a* located at the edge of the area 32 adjoins the non-slot area 34, auxiliary exposing light for the slot 26*a* is available only from a slot 26*b* just inward of the slot 26*a*. It is therefore likely that the quantity of exposing light for the slot 26*a* is absolutely short. As a result, the BM film is apt to remain in the portions of the fluorescent surface 16 where stripes should be formed, as discussed earlier.

Thus, the problem with the conventional shadow mask is that an insufficient amount of auxiliary light for exposure is available for the slots adjoining the edges of the slot area of the mask, particularly the slots close to the corners of the mask. It is therefore likely that the quantity of light for such slots is absolutely short, resulting in the local omission of stripes on a fluorescent surface.

SUMMARY OF THE INVENTION

It is therefore an object of the present invention to provide a shadow mask for a color CRT and free from the local omission of stripes to produce a display which is enhancing the quality of a fluorescent surface, and a method of producing the same.

In accordance with the present invention, in a shadow mask having a sheet of metal formed with vertical arrays of slots formed in a slot area thereof, the slots each consists of a large hole and a small hole communicated to each other and each being formed in one of the front and rear of the sheet of metal. The centers of the small holes are sequentially increasingly deviated from the centers of the respective large holes in the horizontal direction such that the slots located at the edge of the slot area are opposite to the other slots with respect to the direction of deviation, as seen in the section of a short side in the horizontal direction. As a result, the slots at the edge intercept or reduce the quantity of direct light contained in exposing light, while allowing reflections to pass therethrough.

BRIEF DESCRIPTION OF THE DRAWINGS

The above and other objects, features and advantages of the present invention will become apparent from the following detailed description taken with the accompanying drawings in which.

In the drawings, identical reference numerals designate identical structural elements.

DESCRIPTION OF THE PREFERRED EMBODIMENT

Figure 1:
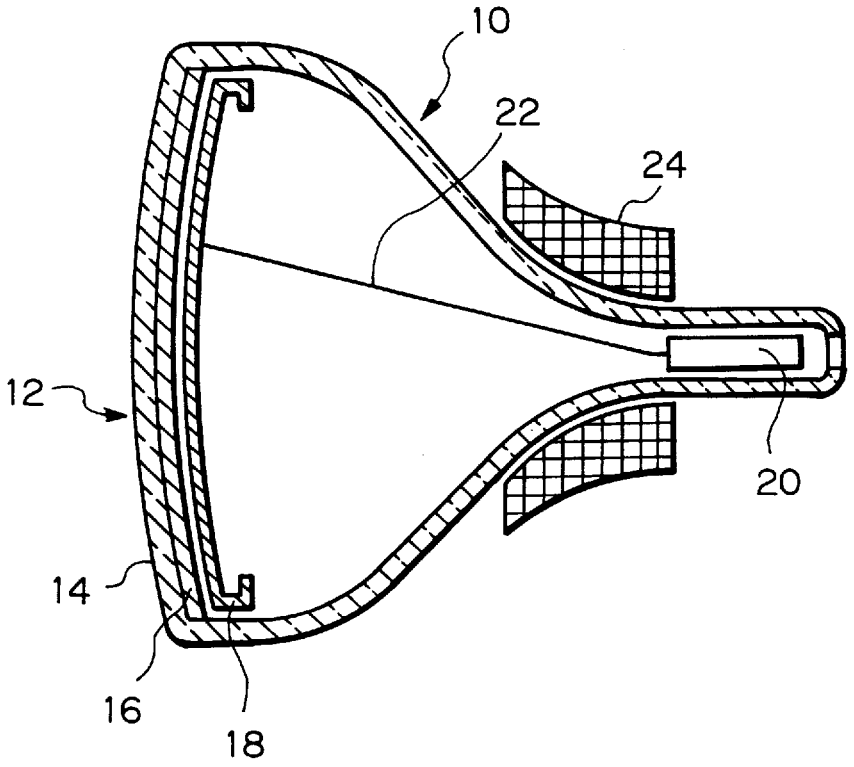
Fig. 1 PRIOR ART
FIG. 1 is a section showing the basic construction of a color CRT.
Figure 2:
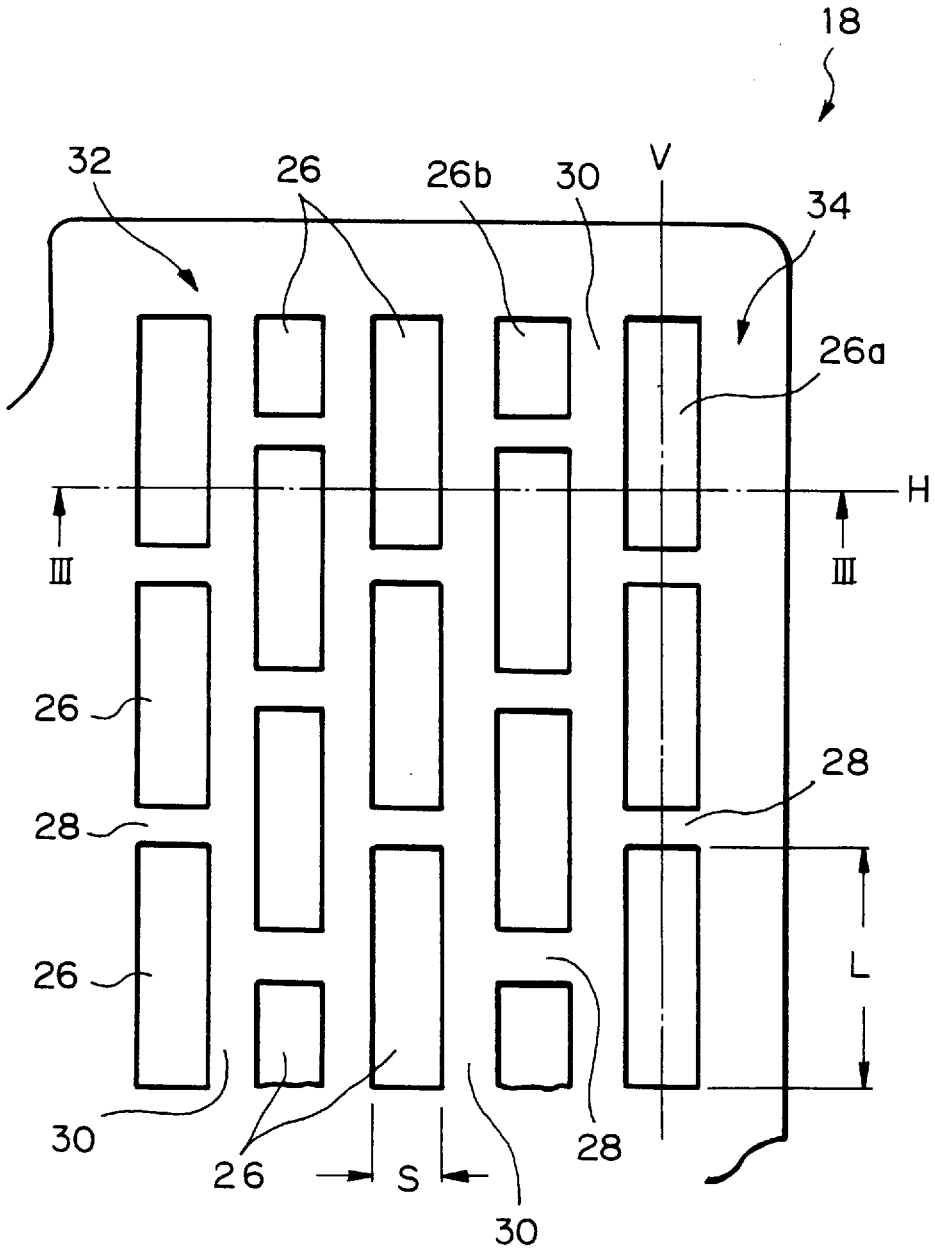
Fig. 2 PRIOR ART
FIG. 2 is a fragmentary plan view showing a conventional shadow mask included in the color CRT.
Figure 3:
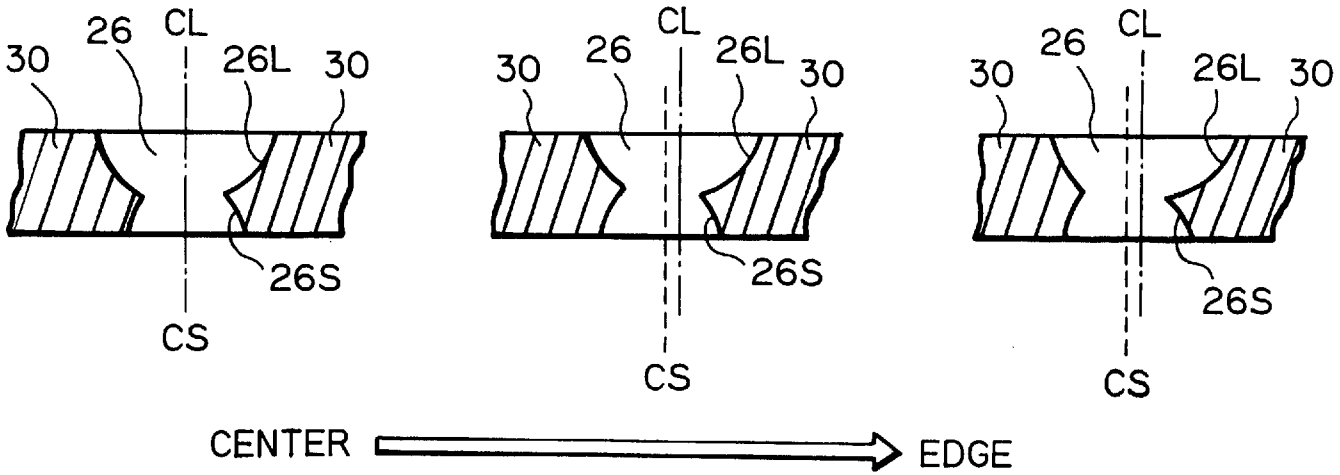
Fig. 3 PRIOR ART
FIG. 3 is a section along line III—III of FIG. 2.
Figure 4:
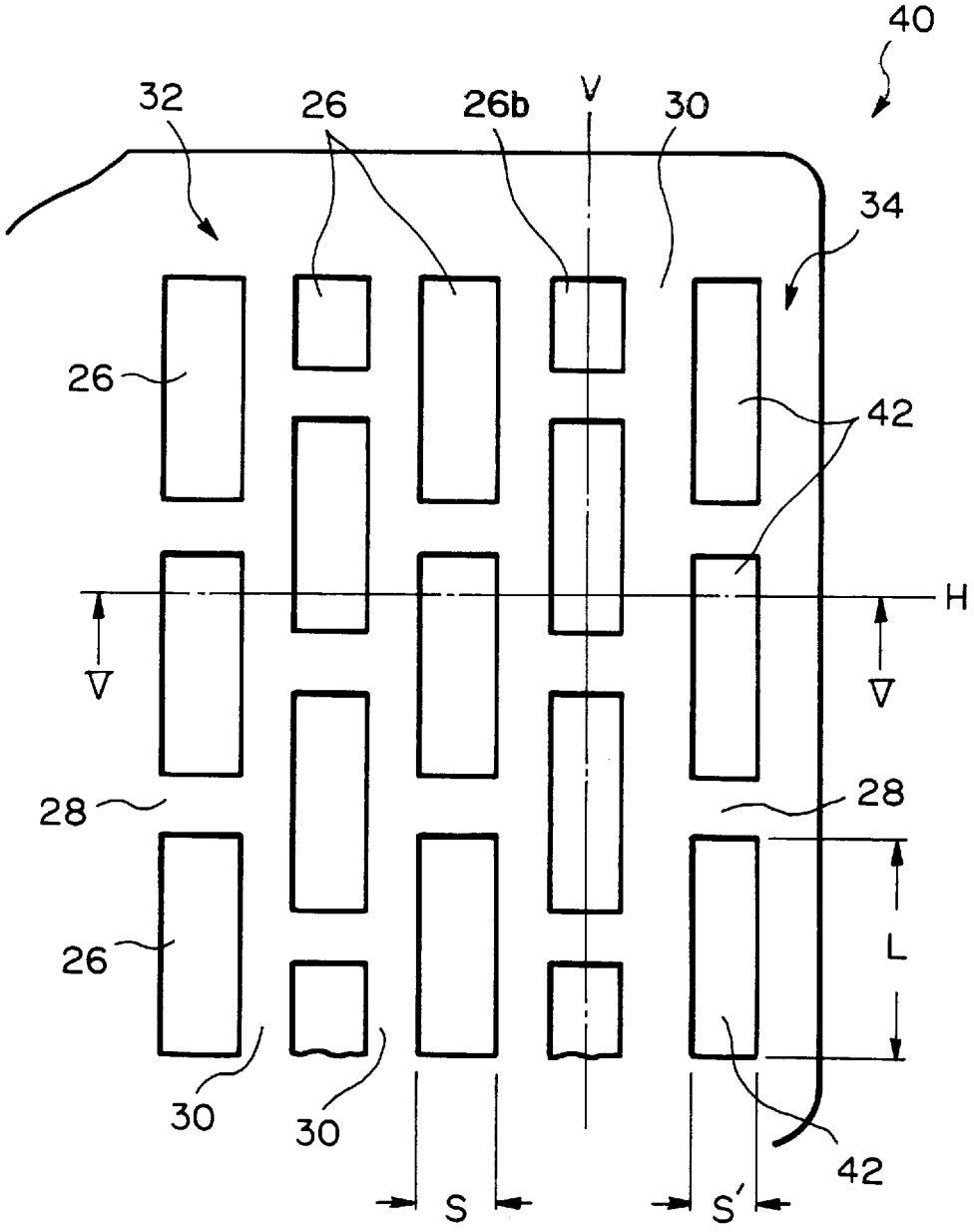
FIG. 4 is a fragmentary plan view showing a shadow mask embodying the present invention.

Referring to FIGS. 4, 5, 6A and 6B, a shadow mask embodying the present invention will be described. As shown in FIG. 4, the shadow mask, generally 40 has a number of slots 26 each having a length L in the vertical direction V and a standard width S in the horizontal direction H. However, only slots 42 located at the outer edges of the shadow mask 40 each have a width S' slightly smaller than the standard width S. Again, the slots 26 or 42 adjoining in the vertical direction V are spaced by bridge portions 28 while the slots 26 and the slots 26 and 42 adjoining in the horizontal direction H are spaced by connecting portions 30.

Figure 5:
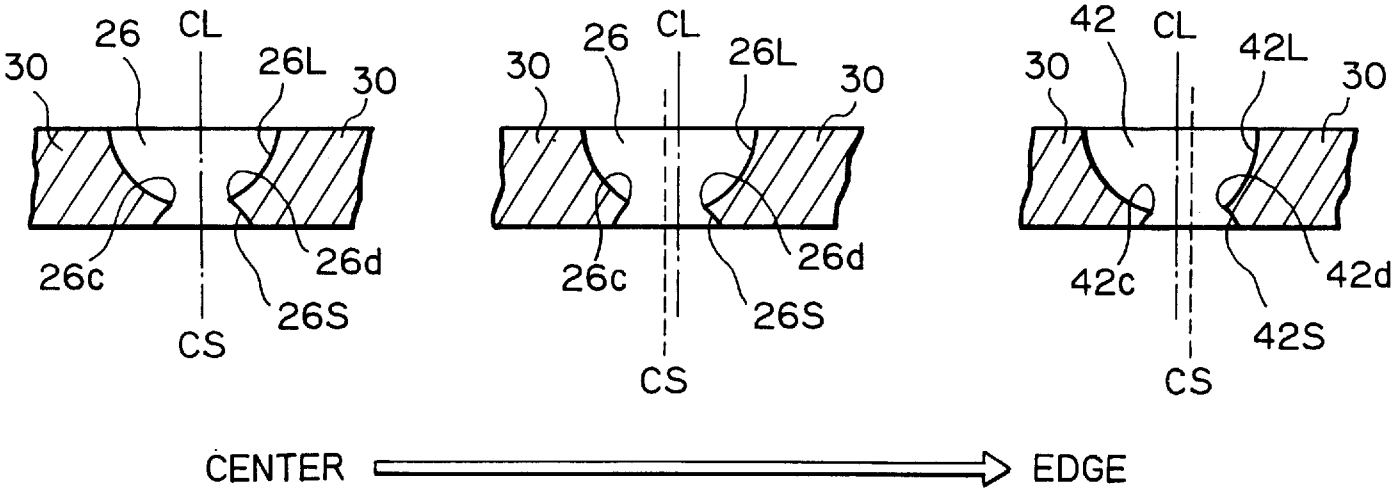
FIG. 5 is a section along line V—V of FIG. 4.

A particular resist pattern is formed on each of the front and rear of the shadow mask 40, and then the mask 40 is etched. As a result, as shown in FIG. 5, large rectangular holes 26L and 42L are formed in the front of the shadow mask 40 while small rectangular holes 26S and 42S are formed in the rear of the mask 40. The holes 26L and 26S or 42L and 42S communicated to each other constitute the desired slots 26 or 42.

Specifically, to form the slots 26 and 42 in the mask 40, a resist pattern for forming the large holes 26 and 42L and a resist pattern for forming the small holes 26S and 42S are respectively formed on the front and rear of a thin sheet of metal. Subsequently, the front and rear of the sheet of metal are etched in order to form the large holes 26L and 42L and small holes 26S and 42S. As shown in FIG. 5, each large hole 26L or 42L and the associated small hole 26L or 42S are communicated to each other by the slot 26 or 42 delimited by edges 26*c* and 26*d* or 42*c* and 42*d*.

As shown in FIG. 5, at the center of the mask 40, the center CL of the large hole 26L and the center CS of the small hole 26S forming one slot 26 together with the hole 26S are coincident with each other. On the other hand, the centers CS of the other small holes 26S are each deviated from the center CL of the associated large hole 26L with CS being deviated toward the center of the mask 18. The deviation of the center CS from the center CL sequentially increases from the center toward each edge of the mask 18. Such a configuration is identical with the conventional configuration. In the illustrative embodiment, only the large holes 42 located at the edge are configured such that the center CS of each small hole 42S is deviated from the center CL of the associated large hole 42L toward the non-slot area 34 of the mask 40. With this configuration, the outermost slots 42 intercept or reduce the quantity of, among the exposing light, light directly incident thereto while allowing reflections from, e.g., the casing of an exposing device to pass therethrough.

Figure 6B:
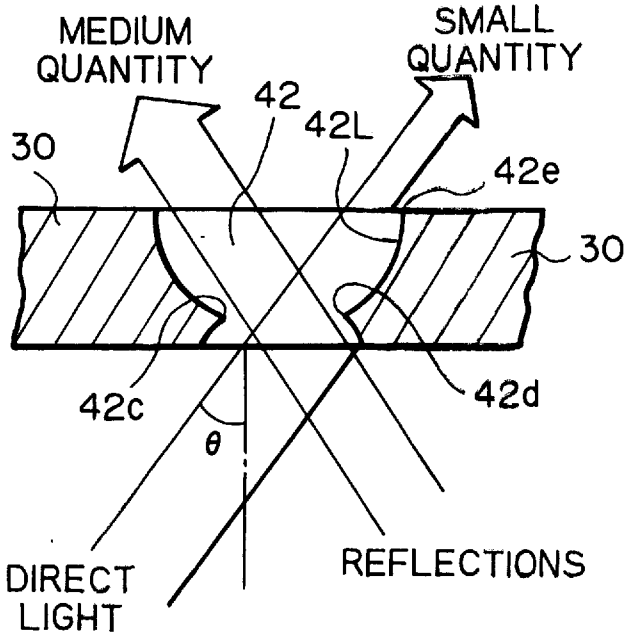
FIGS. 6A and 6B are sections showing a relation between slots formed in the shadow mask of FIG. 4 and the quantity of light to pass therethrough.
Figure 6A:
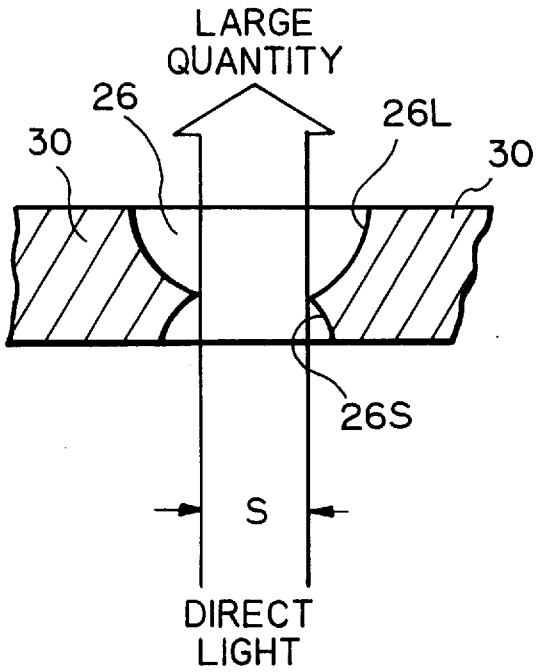

FIGS. 6A and 6B show a relation between the slots 26 and 42 of the shadow mask 40 and the quantity of light to pass therethrough. As shown in FIG. 6A, at the center of the mask 40, the exposing light directly incident to the slot 26 passes through the slot 26 over the standard width 5, and therefore in a large quantity. As shown in FIG. 6B, the direct light is incident to each outermost slot 42 at an angle of 0, and therefore intercepted or reduced in quantity by an edge 42*c* where the holes 42L and 42S adjoin and the edge 42*e* of the hole 42L. However, reflections from, e.g., the casing of an exposing device are passed through the slot 42. The reflections passing through the slot 42 are combined with light of regular quantity passing through the slot 26*b* just inward of the slot 42 at the time of exposure. Therefore, the reflections play an important role as auxiliary light.

In summary, in accordance with the present invention, a part of slots formed in a shadow mask and located at the edges each has a horizontal section so configured as to intercept or reduce the quantity of, among exposing light, direct light directly incident thereto while allowing reflections from, e.g., the casing of an exposing device to pass therethrough. The mask is therefore free from the local omission of stripes ascribable to short exposure at its outermost edges, particular at its corner portions. This enhances the quality of a fluorescent surface. In addition, because the outermost slots allow reflections to pass therethrough, the conventional amount of exposure is available for the vertical array of slots just inward of the outermost slots.

Various modifications will become possible for those skilled in the art after receiving the teachings of the present disclosure without departing from the scope thereof. For example, the large holes and small holes formed in the front and rear of the shadow mask may be replaced with each other, depending on the thickness and other factors of the mask.

What is claimed is:

1. In a shadow mask comprising a sheet of metal formed with vertical arrays of slots formed in a slot area thereof, said slots each comprise a large hole and a respective small hole communicated to each other and each being formed in one of a front and a rear of said sheet of metal, wherein the small holes are arranged relative to the large holes such that in a central region of the mask, the centers of the small holes are aligned with the centers of the respective large holes, and in an intermediate region of the mask other than the central portion and other than edge portions, centers of the small holes are sequentially increasingly deviated from centers of the respective large holes in a first horizontal directions, and at the edge portions, the centers of the small holes deviate from the centers of the respective large holes in a second direction opposite the first direction of deviation in the intermediate region, whereby said slots located at the edge portions intercept or reduce a quantity of direct light contained in exposing light, while allowing reflections to pass therethrough.

2. A shadow mask as claimed in claim 1, wherein said large holes and said small holes are respectively formed in the front and the rear of said slot area.

3. A shadow mask as claimed in claim 1, wherein said large holes and said small holes are respectively formed in the rear and the front of said slot area.

4. A shadow mask as claimed in claim 1, wherein the section of the short side of each of said slots located at the edge is formed by a resist pattern of said large holes and a resist pattern of said small holes.

5. The shadow mask of claim 1, wherein said first direction is towards the central region of the mask.

6. The shadow mask of claim 5, wherein said second direction is away from the central region of the mask towards an edge portion of the mask.

7. In a shadow mask comprising a sheet of metal formed with vertical arrays of slots formed in a slot area thereof said slot area including a central slot area and an edge slot area, said slots each comprising a large hole and a respective small hole communicated to each other and each being formed in one of a front and a rear of said sheet of metal, and wherein the small holes are arranged relative to the large holes such that in the central slot area, the centers of the small holes are aligned with the centers of the respective large holes to provide slots with a first effective width, and wherein in the edge slot area, the centers of the small holes are skewed away from the central slot area relative to the centers of the respective large holes to provide slots with a second effective width, said second effective width being smaller than said first effective width, whereby said slots at the slot edge area intercept or reduce a quantity of direct light contained in exposing light, while allowing reflections to pass therethrough.

* * * * *

UNITED STATES PATENT AND TRADEMARK OFFICE

CERTIFICATE OF CORRECTION

PATENT NO. :5,856,725

DATED :January 5, 1999

INVENTOR(S) :Masahiro Ueda

It is certified that error appears in the above-identified patent and that said Letters Patent is hereby corrected as shown below:

Column 3, Line 54 delete "26L or 42L" (first occurrence) and insert --26S or 42S--

Column 3, Line 54 delete "26L or 42S" (first occurrence) and insert --26L or 42L--

Column 3, Line 61 delete "26S" and insert --26L--

Column 4, Line 14 delete "5" and insert --S--

Column 4, Line 16 delete "0" and insert --θ--

Column 4, Line 57 delete "directions" insert --direction--

Signed and Sealed this

Seventh Day of September, 1999

*Attest:*

Q. TODD DICKINSON

*Attesting Officer*

*Acting Commissioner of Patents and Trademarks*